United States Patent [19]

Bachtel et al.

[11] 4,404,088

[45] Sep. 13, 1983

[54] THREE-STAGE HYDROCRACKING PROCESS

[75] Inventors: Robert W. Bachtel, El Cerrito; Dennis R. Cash, Novato, both of Calif.

[73] Assignee: Chevron Research Company, San Francisco, Calif.

[21] Appl. No.: 307,901

[22] Filed: Oct. 2, 1981

[51] Int. Cl.³ ..... C10G 47/16

[52] U.S. Cl. ..... 208/59; 208/111

[58] Field of Search ..... 208/59, 111

[56] References Cited

U.S. PATENT DOCUMENTS

| | | | |
|---|---|---|---|
| 2,945,800 | 7/1960 | Ciapetta et al. | 208/59 |
| 2,945,801 | 7/1960 | Ciapetta et al. | 208/111 X |
| 3,549,515 | 12/1970 | Brainard et al. | 208/59 |
| 3,702,818 | 11/1972 | Streed et al. | 208/59 X |

*Primary Examiner*—Delbert E. Gantz
*Assistant Examiner*—G. E. Schmitkons
*Attorney, Agent, or Firm*—S. R. La Paglia

[57] ABSTRACT

A hydrocracking process of improved flexibility comprises three hydroprocessing stages and a fractionating zone such that the effluent from the first hydroprocessing stage is fractionated into a first fraction consisting of gasoline and lower boiling components, a second fraction, the residuum, having a normal boiling point greater than about 700° F. (370° C.), and a third fraction, the middle and heavy distillate, consisting of the remainder of the effluent of the first hydroprocessing stage. The second fraction undergoes hydrocracking in a second hydroprocessing stage with recycle of the effluent from said second hydroprocessing stage to the fractionation zone, and the third fraction undergoes hydrocracking in a third hydrocracking stage.

4 Claims, 2 Drawing Figures

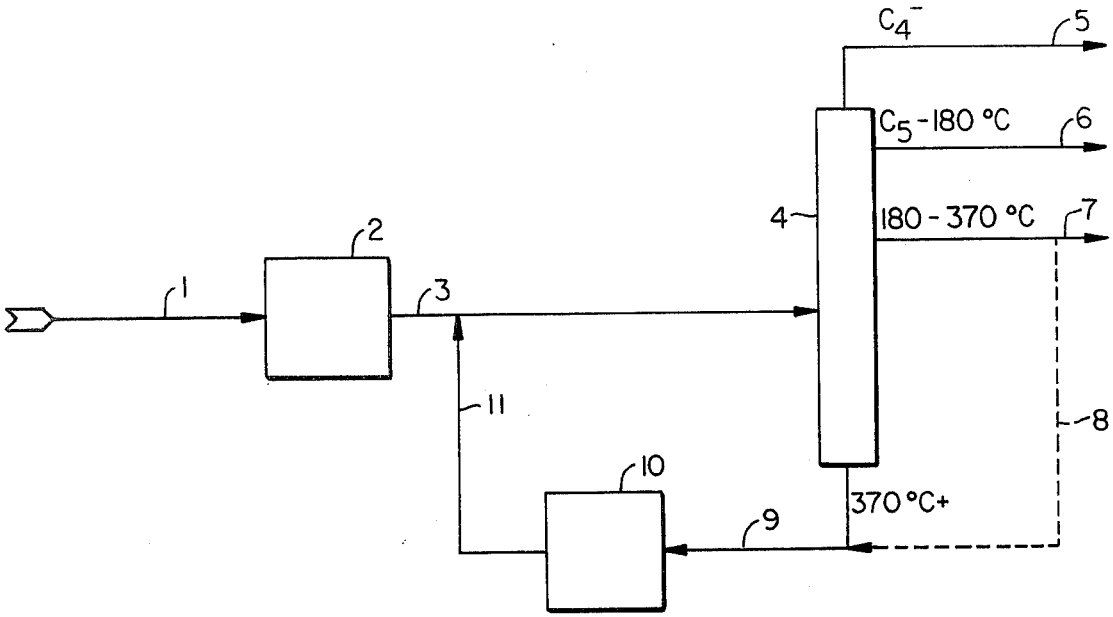
PRIOR ART FIG. 1.
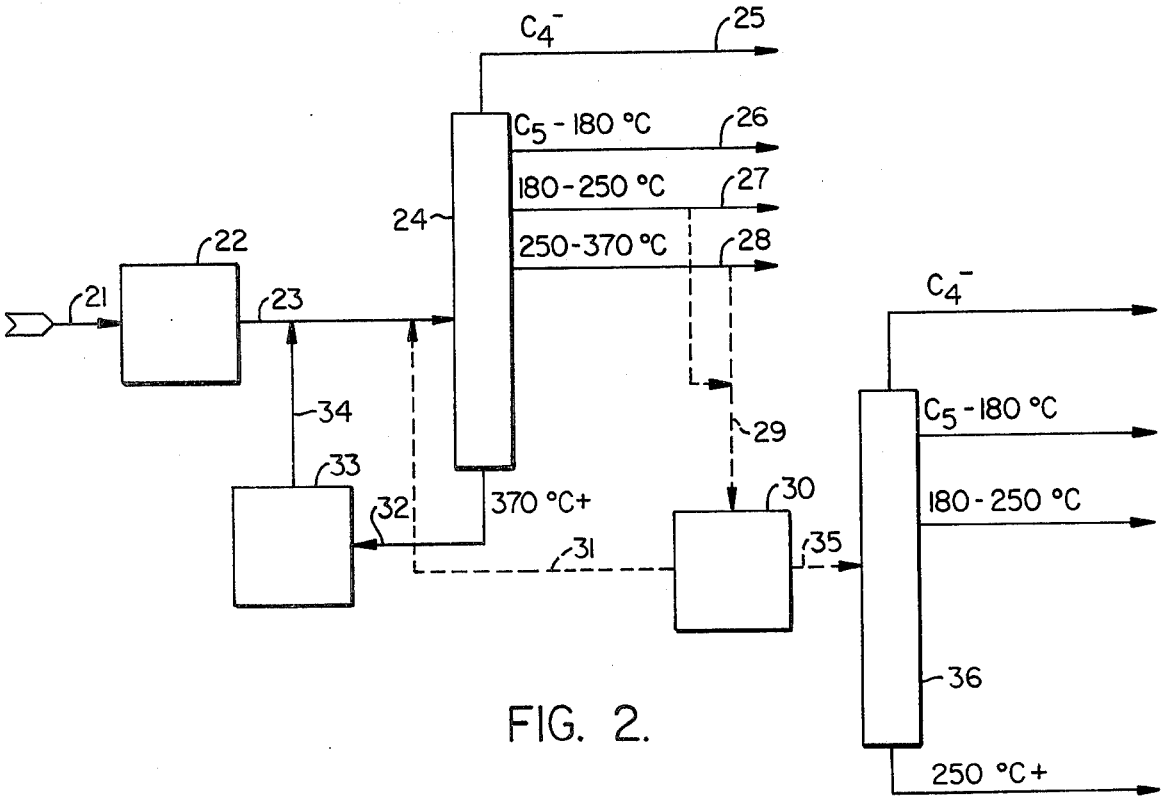
FIG. 2.

THREE-STAGE HYDROCRACKING PROCESS

BACKGROUND OF THE INVENTION

This invention relates to an improved hydrocracking process, and more specifically, it relates to a hydrocracking process of enhanced flexibility. Two-stage hydrocracking processes have been in use for some time (Petroleum Processing Handbook, Bland and Davidson, pp. 3-16 to 3-25, McGraw Hill). In a particular embodiment of the two-stage hydrocracking process, the yield of middle and heavy distillate (e.g., kerosene, jet fuel and diesel fuel) obtainable from a hydrocarbon feedstock is maximized by feeding to the second hydrocracking reactor the bottom fraction of the effluent from the first hydrocracking reactor which boils at about 700° F. (370° C.) or higher. In another particular embodiment of the two-stage hydrocracking process, the yield of naphtha (e.g., gasoline) obtainable from a hydrocarbon feedstock is maximized by feeding to the second hydrocracking reactor that fraction of the effluent from the first hydrocracking reactor which boils at about 360° F. (180° C.) or higher. While it is possible to operate the same two-stage hydrocracking process unit in two modes by charging the feed to the second stage hydrocracking reactor, i.e., maximizing either the middle distillate by feeding bottoms to the second stage or maximizing naphtha by feeding bottoms plus middle and heavy distillate to the second stage, in practice this is not the optimum because the increased throughput requires different hydrocracking catalyst, catalyst activity and hydrocracking conditions for efficient operation of each of these two modes of operation. U.S. Pat. Nos. 2,945,801, 3,702,818, 3,549,515 and 2,945,800 disclose the hydrocracking of hydrocarbon fractions in a plurality of stages. The present invention involves a particular combination of process steps which has for its object the maximization of the yield of either middle distillate or naphtha from the same hydrocracking process unit.

SUMMARY OF THE INVENTION

A three-stage hydrocracking process adapted for maximizing the yield of either naphtha or of certain distillate fractions from a hydrocarbon feedstock, comprising the steps of:

(a) contacting said feedstock in a first hydroprocessing zone with a first hydroprocessing catalyst under hydroprocessing conditions comprising a temperature of about 650°-850° F. (340°-450° C.), a total pressure of 1000-3000 psig, a hydrogen supply of about 500-2000 SCF per barrel of feedstock, and a LHSV of about 0.3-2.5, (b) fractionating the effluent from said first hydroprocessing zone in a fractionating zone into a first fraction consisting of naphtha (gasoline) and lower boiling components preferably having a normal boiling point of about 360° F. (180° C.) or less, a second fraction, the residuum, preferably consisting of components having a normal boiling point greater than about 700° F. (370° C.), and a third fraction, the middle and heavy distillate, consisting of the remainder of the effluent of said first hydroprocessing zone, (c) contacting said second fraction in a second hydroprocessing zone with a hydrocracking catalyst under hydrocracking conditions comprising a temperature of about 600°-850° F. (300°-450° C.), a total pressure of about 1000-3000 psig, a hydrogen supply of about 500-1500 SCF per barrel of feed, and a total LHSV of about 0.8-3.0, (d) recycling the effluent of said second hydroprocessing zone to said fractionation zone, (e) contacting said third fraction in a third hydroprocessing zone with a hydrocracking catalyst of higher cracking activity than the catalysts of said first and second hydroprocessing zones under hydrocracking conditions comprising a temperature of about 550°-850° F. (290°-450° C.), a total pressure of about 800-2500 psig, and a hydrogen supply of 300-1000 SCF per barrel of feed, and optionally, (f) recycling at least a portion of the effluent from said third hydroprocessing zone to said fractionation zone.

In another embodiment of this invention the effluent from the first hydroprocessing zone is combined with the second fraction of the fractionation zone and both are hydrocracked in the second hydroprocessing zone.

In yet another embodiment of this invention, recognizing that said third fraction comprises a middle distillate fraction and a heavy distillate fraction, only the heavy distillate fraction is treated in said third hydroprocessing zone pursuant to step (e), and the middle distillate fraction is not subjected to further treatment in these processing steps.

BRIEF DESCRIPTION OF THE DRAWING

FIG. 1 is a diagrammatic representation of a hydrocracking process of the prior art comprising two stages of hydrocracking and a fractionation zone.

FIG. 2 is a diagrammatic representation of a hydrocracking process comprising three stages of hydrocracking and a fractionation zone in accordance with the present invention and illustrating an embodiment of the flexible hydrocracking process of the present invention.

DETAILED DESCRIPTION OF PREFERRED EMBODIMENTS OF THE INVENTION

The present invention is particularly suited for tailoring the output of a hydrocracking unit to meet the needs for particular fuels. If maximum naphtha (gasoline) is required the entire third fraction is sent to the third hydroprocessing zone which contains a catalyst of higher cracking activity suitable for making naphtha. If maximum middle and heavy distillate is needed, the third fraction need not be further treated and the unit is operated as a two-stage hydrocracker with only the second fraction (residuum) being subjected to a relatively mild hydrocracking. Compare this to the two-stage hydrocrackers of the prior art where in order to maximize naphtha production, the second hydrocracking zone must contain a catalyst of higher cracking activity—thus making it impossible to also maximize mid-distillate production.

If maximum jet and diesel fuel are needed, then according to the present invention only the heavy distillate portion of the third fraction (boiling range about 480°-700° F. (250°-370° C.)) comprising mostly fuel oil and heavy diesel oil need be cracked in the third stage to achieve that result.

In one embodiment, the present invention is particularly adapted to the hydrocracking of feedstocks containing hydrocarbons boiling at temperatures greater than about 360° F. (180° C.) and comprising the full boiling range up to and including fractions having normal boiling points in excess of 1100° F. (600° C.). The feedstock may be a heavy straight run gas oil, a deasphalted oil, a vacuum gas oil, or the like. Because of the poisoning effect on the catalyst caused by cracking of asphaltenes to coke, it is preferred that the hydrocarbon feedstocks to the hydrocracking zones contain less than about 5% by weight of asphaltenes, preferably less than 1% by weight. The hydrocarbon feedstock has a boiling range extending over at least about 100° F. While the sulfur and nitrogen content of the hydrocarbon feedstock to the first hydrocracking zone is not critical, excessive quantities of either sulfur or nitrogen are not desirable. Preferred feedstocks contain less than about 3% of sulfur and less than about 1% of nitrogen by weight.

It should be noted in this regard that while hydrocracking is the primary reaction being carried out, the feedstocks, as noted above, generally contain some hetero-organic compounds of sulfur, nitrogen, oxygen and even metals in some cases. Therefore, hydrodesulfurization, hydrodenitrification, etc., may also be occurring.

Methods are known for treating hydrocarbon oil fractions and their mixtures under a wide variety of elevated temperatures and pressures in the presence of hydrogen and suitable catalytic materials. Hydrocracking reaction zones are generally operated at total pressures on the order of about 500 to 10,000 psig, preferably in the range of about 800 to 3000 psig, and at temperatures in the range of about 400° F. (200° C.) to about 900° F. (480° C.), preferably at about 650° F. (340° C.) to about 800° F. (430° C.). It is necessary to add hydrogen to the feed of a hydrocracker at a rate generally in the range of about 500 to 10,000 SCF of hydrogen per barrel of feed, preferably at about 500 to about 2500 SCF of hydrogen per barrel of feed. Space velocities on the order of 0.3 to 5 volumes of hydrocarbon feed per volume of catalyst per hour (LHSV) are employed, preferably about 0.3 to 3.0 LHSV. Hydrocracking catalysts are so-called dual function type. Such catalysts contain an acidic ingredient to serve as the cracking material in the catalyst and the metallic element to serve as the hydrogenation material. The acidic ingredients are such materials as silica-alumina, silica-magnesia, silica-alumina-titania, silica-alumina-zirconia, beryllium oxide, indium oxide, fluorinated alumina, or various acid-treated clays, as well as zeolitic molecular sieves such as zeolite A, faujasite, zeolite X, zeolite Y, and combinations of zeolites. The metallic element of the catalyst is selected from the metals of Group Vb, VIb, VIIb and VIII of the Periodic Table and/or their oxides and sulfides, elements of Groups VIb and VIII being preferred. Illustrative metallic components of the catalyst include chromium, vanadium, tungsten, and molybdenum. Other materials such as oxides of nickel, iron and cobalt are also usefully employed. In general, the hydrogenating component of the catalyst comprises about 0.1 to 20% by weight of the catalyst. Examples of a hydrocracking catalyst which would be preferred for use in a hydrocracking process step are the combinations of nickel-tungsten-silica-alumina, nickel-molybdenum-silica-alumina and cobalt-molybdenum-silica-alumina. Such catalysts may vary in their activities for hydrogenation and for cracking and in their ability to sustain high activity during long periods of use depending on their compositions and methods of preparation. Obviously the best proven catalysts available are selected, taking into consideration the above factors and cost. A particularly preferred hydrocracking catalyst is a nickel sulfide-tungsten sulfide catalyst on a silica-alumina-titania support. However, for the third hydrocracking zone of the present process it is preferred to select a hydrocracking catalyst of higher cracking activity than those selected for the first and second hydrocracking zones under identical operating conditions. Such higher activity is achievable, for example, by the inclusion of a minor amount of a zeolite, such as zeolite Y, in amounts of about up to 20% by weight based on the total weight of the catalyst.

Referring to FIG. 1 representing prior art practice of two-stage hydrocracking, a hydrocarbon feed is introduced to the process in line 1 (the feed is heated in a furnace and admixed with added hydrogen, not shown). The feed is treated in a once through hydrocracking zone 2 under hydrocracking conditions. The effluent 3 is combined with the effluent 11 from the second hydrocracking zone 10 and passed to a fractionating zone 4. The fractionating zone comprises a distillation section of one or more columns which separates the products into a lowest boiling fraction of butane and lower boiling hydrocarbons 5, a gasoline and heavy gasoline (naphtha) fraction 6 comprising pentanes and higher boiling hydrocarbons having normal boiling points up to about 360° F. (180° C.), a middle and heavy distillate fraction comprising kerosene, jet fuel and diesel fuel as well as fuel oils having a normal boiling point in the range of about 360°–700° F. (180°–370° C.) taken through line 7 (or recycled through line 8 to the second hydrocracking zone 10 in order to maximize naphtha production), and a bottoms fraction having boiling points in excess of 700° F. (370° C.) taken to recycle through line 9. It is characteristic of the prior art process that in order for the second hydrocracking zone to perform its function of maximizing naphtha production, it must contain a catalyst of higher cracking activity. In contrast, the process of the present invention, by using a third state of hydroprocessing, does not require a higher cracking activity catalyst in the second hydroprocessing stage, in fact, it may be the same catalyst as used in the first hydroprocessing zone. When the catalysts of the first and second hydroprocessing zones are both of lower cracking activity, it is possible to maximize middle-distillate production when the third hydroprocessing zone is not in use.

Referring now to FIG. 2 which represents an embodiment of the present invention, a hydrocarbon feed is introduced to the process in line 21 at a suitable pressure and is heated and admixed with hydrogen. Furnaces, hydrogen lines, hydrogen recycle, as well as other components of the process design which are within the skill of ordinary workers in this field, have been omitted from the drawing for clarity. The mixture is brought to a suitably elevated temperature for treatment in a first hydroprocessing reaction zone 22. Reaction zone 22 contains a suitable first hydroprocessing catalyst and is maintained under conditions of elevated temperature and pressure suitable for hydrotreating or hydrocracking. The effluent 23 obtained from hydroprocessing zone 22 is withdrawn in line 23 and passed to fractionation zone 24 after combination with recycle from line 34. The fractionation zone comprises a distillation section of one or more columns which will serve to separate the effluent from all three hydroprocessing stages into a lightest fraction of butane and lower boiling hydrocarbons taken overhead through line 25, a gasoline and heavy gasoline fraction comprising pentanes and higher boiling hydrocarbons having normal boiling points up to about 360° F. (180° C.) taken from line 26, a middle distillate fraction comprising kerosene, jet fuel and diesel fuel having normal boiling points in the range of about 360°-480° F. (180°-250° C.) taken from line 27 or recycled through line 29, a heavy distillate fraction comprising diesel fuel and fuel oils having normal boiling points in the range of about 480° F.-700° F. (250° C.-370° C.) taken through line 28 or recycled to a third hydroprocessing zone 30 through line 29, and a bottoms fraction having boiling points in excess of 700° F. (370° C.) taken to recycle through line 32. The recycled hydrocarbon of line 32 is heated to elevated temperatures for treatment in the second hydrocracking zone 33. Reaction zone 33 contains a suitable hydrocracking catalyst and is maintained under conditions of elevated temperature and pressure to effect hydrocracking of the 700° F.+ (370° C.+) fraction from the fractionation zone. The effluent from the second hydroprocessing zone 33 is withdrawn in line 34 and combined with the effluent 23 from the first hydroprocessing zone 22 and passed to the fractionation zone 24. In an alternative embodiment not shown in FIG. 2, the recycled effluent in line 32 is first combined with the effluent in line 23 before the combined material is sent to the second hydroprocessing zone 33 for combined hydrocracking. The recycled middle distillate and/or heavy distillate is conducted via line 29 for treatment in the third hydroprocessing zone 30. Reaction zone 30 contains a suitable catalyst of higher cracking activity than the hydrocracking catalyst found in the first two hydroprocessing zones 22 and 33. Hydroprocessing zone 30 is maintained under conditions of elevated temperature and pressure to effect hydrocracking of a middle distillate and/or a heavy distillate to the lower boiling fractions. The effluent from the third hydroprocessing zone is removed via line 31 for recycle to the fractionation zone or, optionally, is withdrawn from the hydroprocessing zone via line 35 and sent to a second fractionation zone 36.

It is to be understood that the cut-points between fractions and between middle and heavy distillate are merely representative. In general, cut-points will be selected to represent the best possible design characteristics for the particular feedstock to be processed. Consequently, in actual designs these numbers may vary by up to about 50 degrees from those illustrated here.

EXAMPLES

A vacuum gas oil having a normal boiling range of 705°-1004° F. (375°-540° C.) and derived from Abu Dhabi crude oil, is subjected to two-stage and three-stage hydroprocessing (Table 1). In the two-stage process (illustrated by FIG. 1) the fraction of the first-stage effluent boiling above 700° F. (370° C.) is recycled to a second hydrocracking zone containing a catalyst of greater cracking activity than that of the first stage in both the "Mid-distillate" and the "Naphtha" modes of operation. However, in the Naphtha mode of operation the first-stage effluent fraction boiling between 360° F. (180° C.) and 700° F. (370° C.) is also recycled to the second hydrocracking stage (illustrated by the dotted line 8 FIG. 1). The results are shown in the first two columns of Table 1 where it is seen that the Naphtha mode produces more than 100 LV% of $C_5$-180° C. and the 180°-370° C. fraction is recycled to extinction. However, in the "Mid-distillate" mode the two-stage hydrocracking process produces only 41.1 LV% of the 250°-370° C. fraction and still produces 39.8 LV% of $C_5$-180° C. The catalyst of the first stage is a silica-alumina catalyst containing catalytic amounts of nickel and tungsten. The catalyst of the second stage is a higher severity silica-alumina catalyst containing catalytic amounts of nickel and tin.

In the three-stage hydroprocessing examples reported in Table 1, the same feedstock is used as in the two-stage process and the catalyst of the first and second stages of the three-stage process is the same as that of the first stage of the two-stage process. However, the catalyst of the third stage also contains a catalytic amount of Y Zeolite. In "Naphtha" mode of operation the first stage effluent fraction boiling between 360° F. (180° C.) and 700° F. (370° C.) is sent via line 29 of FIG. 2 to the third hydrocracking zone 30. In "Mid-distillate" mode of operation only the 700° F.+ (370° C.+) fraction is recycled via line 32 of FIG. 2 to a second hydroprocessing zone, the middle and heavy distillates are run straight out via lines 27 and 28. One advantage of the three-stage hydroprocessing process over the two-stage process lies in the ability of the process to accommodate a variety of catalysts in each stage. In particular, by placing the catalyst of higher cracking activity in the third hydroprocessing zone rather than in the second hydroprocessing zone as in the two-stage process, the three-stage process produces much more heavy distillate (useful as diesel and fuel oils) in the mid-distillate mode at the expense of the naphtha fraction than the two-stage process is capable of producing. Yet when higher cracking activity is needed to maximize naphtha production, the three-stage process subjects the middle and/or heavy distillate fractions to the higher cracking activity of the third hydroprocessing stage. In Case A the effluent of the third stage is recycled to the first fractionation zone (via line 31 of FIG. 2), while in Case B the effluent of the third stage is sent to a second fractionation zone (via line 35 of FIG. 2). Since the third stage is only active in the "Naphtha" mode of operation, the yields in Case A and Case B are identical in the "Mid-distillate" mode of operation.

The advantages of three-stage hydroprocessing of the present invention over two-stage hydrocracking are evident from Table 1 in that: (1) substantially the same amount of naphtha can be produced in three-stage hydroprocessing (Case A 100.3 LV%) as in two-stage hydrocracking (101.3 LV%); but (2) substantially more mid-distillate (51.6 LV%) Case A or B) is produced in three-stage hydroprocessing than in two-stage hydrocracking (41.1 LV%); and the consumption of hydrogen is reduced in each mode of operation of three-stage hydroprocessing in comparison with two-stage hydrocracking hydrogen consumption.

TABLE 1

| | Two-stage Hydrocracking | | Three-Stage Hydroprocessing | | | |
|---|---|---|---|---|---|---|
| | | | Case A | | Case B | |
| Yields | Mid-Dist. | Naphtha | Mid-Dist. | Naphtha | Mid-Dist. | Naphtha |
| $C_1 + C_2$, Wt % | 0.58 | 0.73 | 0.6 | 0.74 | 0.6 | 0.90 |

TABLE 1-continued

| Yields | Two-stage Hydrocracking | | Three-Stage Hydroprocessing | | | |
|---|---|---|---|---|---|---|
| | | | Case A | | Case B | |
| | Mid-Dist. | Naphtha | Mid-Dist. | Naphtha | Mid-Dist. | Naphtha |
| $C_3$, Wt % | 1.64 | 5.07 | 1.5 | 4.07 | 1.5 | 3.33 |
| $C_4$, LV % | 7.3 | 25.5 | 5.7 | 20.0 | 5.7 | 17.6 |
| $C_5$-180° C., LV % | 39.8 | 101.3 | 30.4 | 100.3 | 30.4 | 81.1 |
| 180–250° C., LV % | 25.2 | — | 24.6 | — | 24.6 | 16.4 |
| 250–370° C., LV % | 41.1 | — | 51.6 | — | 51.6 | 6.5 |
| Total $C_5$+, LV % | 106.1 | 101.3 | 106.6 | 100.3 | 106.6 | 104.0 |
| Chemical Hydrogen Consumption, SCF/bbl feed | 1550 | 2250 | 1400 | 2120 | 1400 | 1870 |

What is claimed is:

1. A three-stage hydrocracking process adapted for maximizing the yield of naphtha, or of maximizing the yield of certain other distillate fractions from a feedstock containing hydrocarbons boiling at temperatures greater than about 360° F. (180° C.), comprising the steps of:

(a) contacting said feedstock in a first hydroprocessing zone with a first hydroprocessing catalyst under conditions comprising a temperature of about 650°–850° F., a total pressure of about 1000–3000 psig, a hydrogen supply of about 500–2000 SCF per barrel of feedstock and a LHSV of 0.3–2.5, (b) fractionating the effluent from said first hydroprocessing zone in a fractionating zone into a first fraction consisting of naphtha and lower boiling components, a second fraction, the residuum, consisting of components having a normal boiling point greater than about 700° F., and a third fraction, the middle and heavy distillate, consisting of the remainder of the effluent of said first hydroprocessing zone, (c) contacting said second fraction in a second hydroprocessing zone with a hydrocracking catalyst under hydrocracking conditions comprising a temperature of about 600°–850° F., a total pressure of about 1000–3000 psig, a hydrogen supply of about 500–1500 SCF per barrel of feed and a total LHSV of about 0.8–3.0, (d) recycling the effluent of said second hydroprocessing zone to said fractionation zone, (e) contacting said third fraction in a third hydroprocessing zone with a zeolite-containing hydrocracking catalyst of higher cracking activity than the catalysts of said first and second hydroprocessing zones, under hydrocracking conditions comprising a temperature of about 550°–850° F., a total pressure of about 800–2500 psig and a hydrogen supply of about 300–1000 SCF per barrel of feedstock, and (f) recycling at least a portion of the effluent from said third hydroprocessing zone to said fractionation zone.

2. A process according to claim 1 wherein the effluent from said first hydroprocessing zone is combined with the second fraction of said fractionating zone before both are hydrocracked in said second hydroprocessing zone.

3. A process according to claim 1 wherein said third fraction comprises a middle distillate fraction and a heavy distillate fraction and only said heavy fraction is treated in said third hydrocracking zone.

4. A process according to claim 3 wherein said mid-distillate fraction has a normal boiling point in the range of about 360°–480° F. and said heavy distillate fraction has a nornal boiling point in the range of about 480°–700° F.

* * * * *